US010451095B2

(12) United States Patent
Wells

(10) Patent No.: US 10,451,095 B2
(45) Date of Patent: Oct. 22, 2019

(54) CONTROL SYSTEM FOR A CONTROL VALVE

(71) Applicant: Schlumberger Technology Corporation, Sugar Land, TX (US)

(72) Inventor: Larry Wells, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 378 days.

(21) Appl. No.: 15/476,514

(22) Filed: Mar. 31, 2017

(65) Prior Publication Data

US 2018/0283420 A1 Oct. 4, 2018

(51) Int. Cl.

| | |
|---|---|
| ***F15B 7/00*** | (2006.01) |
| ***F15B 21/08*** | (2006.01) |
| ***E21B 15/00*** | (2006.01) |
| ***F15B 15/14*** | (2006.01) |

(52) U.S. Cl.

CPC ..... *F15B 21/087* (2013.01); *E21B 15/00* (2013.01); *F15B 15/149* (2013.01)

(58) Field of Classification Search

CPC ..... F15B 9/07; F15B 9/08; F15B 9/09; F15B 9/10; F15B 9/12; F15B 15/149; F15B 2211/255; F15B 2211/30575; F15B 2211/327; F15B 2211/426; F15B 2211/427; F15B 2211/63; F15B 2211/665; F15B 7/00; F15B 7/001; E21B 15/045

See application file for complete search history.

(56) References Cited

U.S. PATENT DOCUMENTS

| | | | | |
|---|---|---|---|---|
| 8,807,522 | B2 * | 8/2014 | Okuda | G05B 19/0423 251/129.01 |
| 2005/0209750 | A1 * | 9/2005 | Masamura | B60G 17/015 701/38 |
| 2012/0248356 | A1 * | 10/2012 | Okuda | F16K 31/12 251/129.15 |

* cited by examiner

*Primary Examiner* — Gary L Laxton

(74) *Attorney, Agent, or Firm* — Rachel E. Greene

(57) ABSTRACT

Apparatus and methods for controlling a hydraulic cylinder with a control valve in a control system. The control system comprises a voltage level shifter that produces a shift reference voltage (SHRv) substantially equal to the fraction value of a valve power supply voltage (VPSv). A controller produces a control system output voltage (CNTo) with a positive value, a negative value, or a zero value in response to a control input voltage (CNTi) and the VPSv. A voltage converter receives the SHRv and CNTo, and provides a control signal input voltage (CSi) to the control valve. The CSi is greater than the fraction value of the VPSv when the CNTo is the positive value, less than the fraction value of the VPSv when the CNTo is the negative value, and substantially equal to the fraction value of the VPSv when the CNTo is the zero value.

20 Claims, 6 Drawing Sheets

CONTROL SYSTEM FOR A CONTROL VALVE

BACKGROUND OF THE DISCLOSURE

In the drilling of oil and gas wells, drilling rigs are used to create a well by drilling a wellbore into a formation to reach oil and gas deposits. During the drilling process, as the depth of the wellbore increases, so does the length and weight of the drillstring. A drillstring may include sections of drill pipe, a bottom hole assembly, and other tools for creating a well. The length of the drillstring may be increased by adding additional sections of drill pipe as the depth of the wellbore increases. Various components of a drilling rig can be used to advance the drillstring into the formation.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus having a control system for use with a control valve. The control valve applies non-zero hydraulic pressure to a first port of a hydraulic cylinder when a control signal input voltage (CSi) is greater than a fraction value of a valve power supply voltage (VPSv). The control valve also applies non-zero hydraulic pressure to a second port of the hydraulic cylinder when the CSi is less than the fraction value of the VPSv. The control valve applies zero hydraulic pressure to the first and second ports when the CSi is substantially equal to the fraction value of the VPSv. The control system includes a voltage level shifter that produces a shift reference voltage (SHRv) substantially equal to the fraction value of the VPSv. The control system also includes a controller that produces a control system output voltage (CNTo) with a positive value, a negative value, or a substantially zero value in response to a control input voltage (CNTi) and the VPSv. The control system also includes a voltage converter that receives the SHRv and CNTo and provides the CSi to the control valve. The CSi is greater than the fraction value of the VPSv when the CNTo is the positive value, less than the fraction value of the VPSv when the CNTo is the negative value, and substantially equal to the fraction value of the VPSv when the CNTo is the substantially zero value.

The present disclosure also introduces a method for use with a control valve. The control valve applies non-zero hydraulic pressure to a first port of a hydraulic cylinder when a control signal input voltage (CSi) is greater than a fraction value of a valve power supply voltage (VPSv). The control valve also applies non-zero hydraulic pressure to a second port of the hydraulic cylinder when the CSi is less than the fraction value of the VPSv. The control valve applies zero hydraulic pressure to the first and second ports when the CSi is substantially equal to the fraction value of the VPSv. The method includes producing a shift reference voltage (SHRv) substantially equal to the fraction value of the VPSv, and producing a control system output voltage (CNTo) with a positive value, a negative value, or a substantially zero value in response to a control input voltage (CNTi) and the VPSv. The method also includes providing the CSi as a function of the SHRv and CNTo to the control valve. The CSi is greater than the fraction value of the VPSv when the CNTo is the positive value, less than the fraction value of the VPSv when the CNTo is the negative value, and substantially equal to the fraction value of the VPSv when the CNTo is the substantially zero value.

These and additional aspects of the present disclosure are set forth in the description that follows, and/or may be learned by a person having ordinary skill in the art by reading the material herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
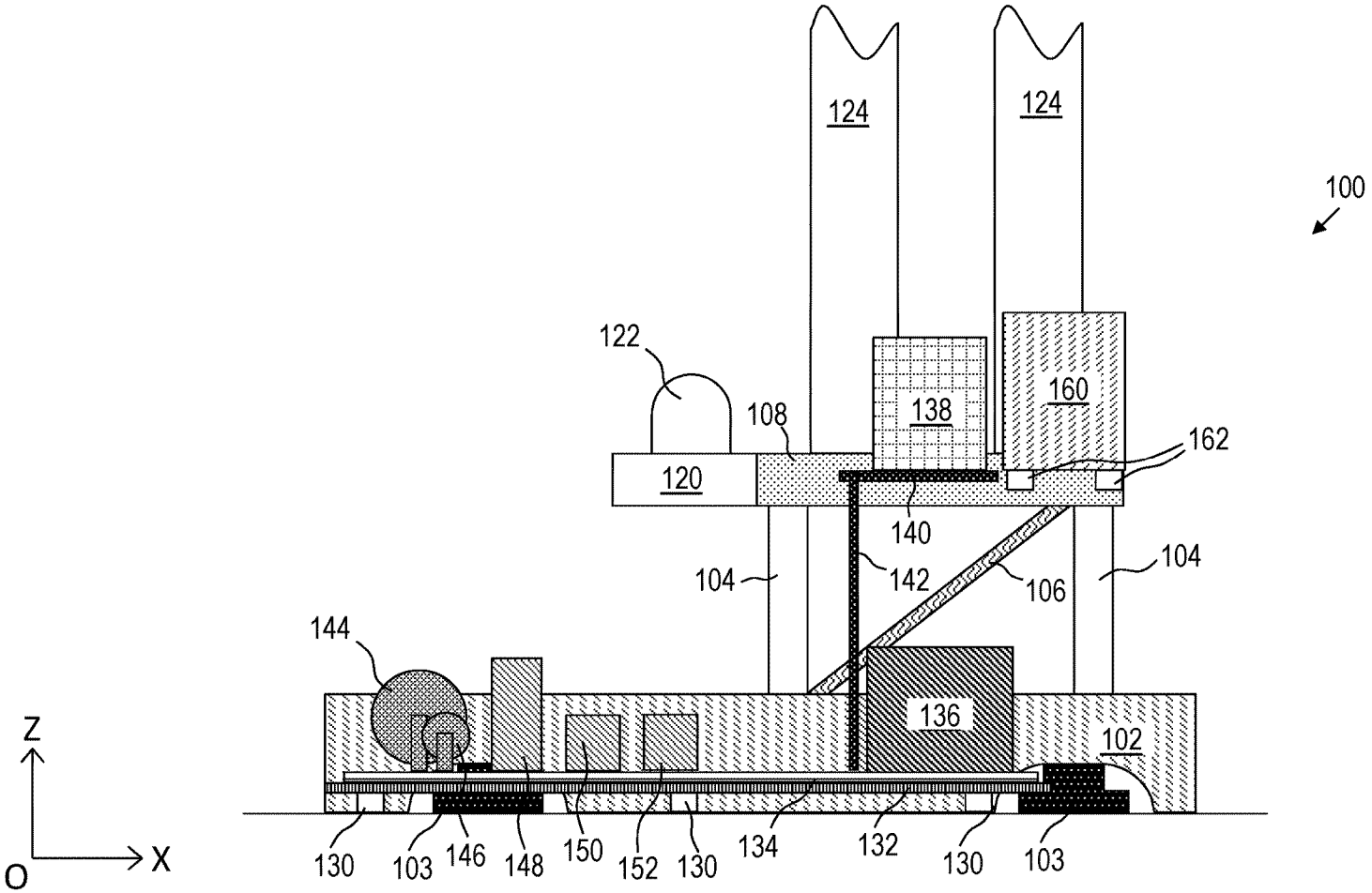
FIGS. 1 and 2 are respective schematic views of at least a portion of a simplified, example implementation of a well construction apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Systems and methods and/or processes according to one or more aspects of the present disclosure may be used or performed in connection with well construction operations, such as at a wellsite for constructing a wellbore to obtain hydrocarbons (e.g., oil and/or gas) from a formation, including drilling the wellbore. For example, some aspects may be described in the context of drilling a wellbore in the oil and gas industry. One or more aspects of the present disclosure may be applied in other contexts, such as for other construction operations.

One or more aspects of the present disclosure may permit simpler deployment of a well construction apparatus where some components (e.g., electrical components) are located at the moveable well construction apparatus (e.g., a "walking" drilling rig). Various examples and modifications are described herein, and a person of ordinary skill in the art will readily understand other modifications that can be made to those examples and modifications, which are also within the scope of the present disclosure.

Figure 2:
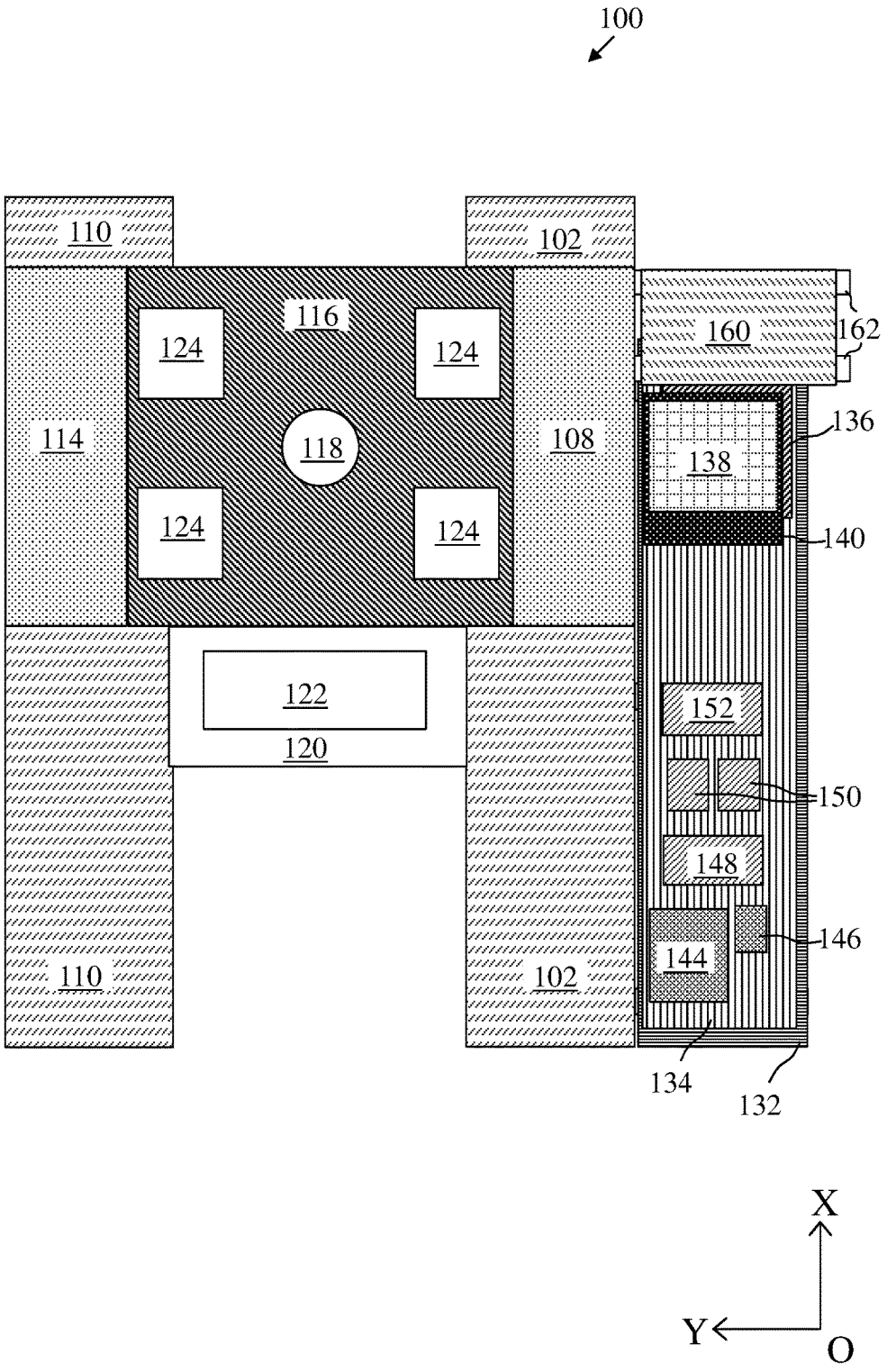

FIGS. 1 and 2 are respective schematic views of at least a portion of a simplified, example implementation of a well construction apparatus 100 according to one or more aspects of the present disclosure. FIGS. 1 and 2 illustrate different schematic views of the well construction apparatus 100 and will be described together. Each of these figures includes an approximate orientation point O with X-Y-Z coordinate axes to facilitate orienting the different views. FIGS. 1 and 2 illustrate the well construction apparatus 100 where, after at least some modules have been deployed, a portion of the well construction apparatus 100 is raised. Examples of deployment and raising of a portion of the well construction apparatus 100 are described below.

The well construction apparatus 100 in this example may be deployed to a wellsite as separate modules, each of which may be transported to the wellsite by a separate vehicle (e.g., a truck and trailer). The various modules may be arranged at the wellsite and mechanically attached together as appropriate. Various ones of example modules are described below with respect to the well construction apparatus 100, and other implementations may have fewer, additional, and/or different modules.

The well construction apparatus 100 includes two side box modules, a center (or rig floor) module, a drawworks module, a mast module, a driller control room module, and a local electrical room module. In the deployment of these modules at the wellsite (e.g., "rig up"), the side box modules are arranged in parallel at the wellsite. A first side box module includes a first footing structure 102, first moveable support structures 104, a hydraulic lift formed with a hydraulic cylinder 106, and a first rig floor frame 108. A second side box module includes a second footing structure 110, second moveable support structures (not specifically illustrated), a hydraulic lift (not specifically illustrated), and a second rig floor frame 114. The first and second side box modules together form at least a portion of a substructure of the well construction apparatus 100. As initially deployed, the first and second side box modules are collapsed, and, as will become apparent from subsequent description, the first and second side box modules include a hydraulics system (e.g., including the hydraulic cylinder 106) that raises a rig floor of the well construction apparatus 100. When the hydraulics system is operated, the first moveable support structures 104 and the second moveable support structures can rotate around respective hinge points in the first footing structure 102 and the first rig floor frame 108, and in the second footing structure 110 and the second rig floor frame 114, to expand the first and second side box modules and raise the rig floor of the well construction apparatus 100.

For example, the hydraulic lift includes the hydraulic cylinder 106 that is formed with a hydraulic control valve that applies hydraulic pressure to a first port or a second port of the hydraulic cylinder in response to a voltage level of an input signal thereto. The hydraulic control valve applies zero pressure to the first port and the second port of the hydraulic cylinder when the voltage level of the input signal is set to a particular value. In this manner, the voltage level of the input signal is employed to controllably raise and maintain a position of the rig floor of the well construction apparatus 100. A process for controlling the voltage level of the input signal is described below.

Additionally, the first footing structure 102 and the second footing structure 110 each include two hydraulically controlled feet 103 that are operated by another hydraulic cylinder. In other examples, more hydraulically controlled feet may be used. The feet 103 can be controlled to move (e.g., "walk") the well construction apparatus 100 to and from different locations at the wellsite, e.g., after the well construction apparatus 100 has been fully deployed, by controlling a voltage level of an input signal to the another hydraulic cylinder. The well construction apparatus 100 also includes a hydraulics system that controls the operations of the feet 103, such as described below.

With the first and second side box modules deployed in parallel at the wellsite, the center module is deployed between the first and second side box modules. The center module is attached to the first rig floor frame 108 and the second rig floor frame 114. The center module includes a rig floor frame that further forms at least a portion of the substructure of the well construction apparatus 100 and includes a rig floor 116. The first rig floor frame 108, the second rig floor frame 114, and the rig floor 116 form a rig floor structure. An opening 118 extends through the rig floor 116. During some operations of the well construction apparatus 100, such as drilling, a drillstring or other tubulars may extend through the opening 118 to a formation in the underlying earth.

The drawworks module may be deployed attached to the center module and/or the first and second side box modules. The drawworks module includes a drawworks skid 120 that is attached to the center module (e.g., the rig floor 116 and/or rig floor frame) and/or to the first rig floor frame 108 and second rig floor frame 114. A drawworks 122, which may be used for raising and lowering a drillstring during drilling operations, is mounted on the drawworks skid 120.

The mast module is deployed on the rig floor 116. In this example, the mast module includes a mast 124 (a portion of which is shown in the figures). From a vehicle on which the mast module is transported, the mast module is attached to the rig floor 116 at one or more anchor points and is rotated around the anchor point(s) to an upright position. A hydraulics system may be used to rotate the mast 124 into the upright position. The mast 124 may then be telescopically extended to a mast height, if the mast 124 is a telescoping mast, or the mast 124 may be fully assembled to its final length prior to rotation into the upright position. A crown block (not shown) may be at and supported by an upper portion of the mast 124.

The mast module further includes a top drive (not illustrated) with associated rotary motor, gear box or transmission, drive shaft, and swivel. A hook and traveling block may be mechanically coupled to the top drive. The top drive may have a rail guide system on the mast 124 that guides the top drive along vertical movement during drilling operations and prevents the top drive from rotating as a result of torque that the top drive applies to a drillstring during drilling operations.

The local electrical room module is deployed adjacent the first side box module. The first footing structure 102 of the first side box module includes support beams 130 that support the local electrical room module during deployment of the local electrical room module. The support beams 130 may be hinged at the first footing structure 102. During transport of the first side box module, the support beams 130 may be folded, by operation of the hinge, to the first footing structure 102. In preparation of deployment and during deployment of the local electrical room module, the support beams 130 may be unfolded to extend perpendicularly from the first footing structure 102 to support the local electrical room module. By having the support beams 130 extending from the first footing structure 102 and supporting the local electrical room module, the well construction apparatus 100 may be repositioned without separately repositioning the local electrical room module during a rig walk operation, for example.

A skid support 132 may be used to further support the local electrical room module. The skid support 132 can be a rigid frame, for example, separate from the local electrical room module. The skid support 132 can be placed on the support beams 130 prior to skidding of the local electrical room module. The skid support 132 can facilitate skidding the local electrical room module on the support beams 130.

The local electrical room module includes a skid 134 that supports various other components of the local electrical room module. The skid 134 and the components mounted thereon can be unloaded from a vehicle (e.g., a trailer) by a pulley system that forces the skid 134 from the vehicle and onto the skid support 132, where the skid 134 is then slid into position on the skid support 132.

A lower electrical room 136 is mounted on the skid 134. The lower electrical room 136 can include various electrical components, such as for control (such as programmable logic controllers (PLCs)), communication, and/or others. Some components that can be included in some examples are described in further detail below.

A raisable apparatus 138 is mounted on a horizontal floor 140, which is attached to and supported by a boom 142 and actuated by one or more hydraulic cylinders. The raisable apparatus 138 can be or comprise various components. For example, the raisable apparatus 138 may include one or more plug panels to which one or more cables on the rig floor can be connected. One or more cables can then extend from the raisable apparatus 138 along and supported at least in part by the boom 142 to, e.g., the lower electrical room 136. The horizontal floor 140 is attached to the boom 142 by a joint, hinge, or the like, for example, at one end of the boom 142. The boom 142 is attached to and supported by the skid 134 by a joint, hinge, or the like, for example, at the other end of the boom 142, which may allow for rotation of the boom 142 around the joint, hinge, or the like. During transport, the horizontal floor 140 and boom 142 are collapsed or folded (e.g., in a "Z" configuration with the skid 134). Various mechanisms may be present to prevent the horizontal floor 140 and boom 142 from collapsing or folding fully to the skid 134, such as blocks, stops, pins, and/or other example mechanisms. Hence, the boom 142 may be rigid enough to support the horizontal floor 140 and raisable apparatus 138, e.g., during transport. The horizontal floor 140 and boom 142 may also collapse or fold fully to the skid 134.

At deployment, the horizontal floor 140 can be mechanically coupled to the first rig floor frame 108, for example. The horizontal floor 140 may be mechanically coupled to the first rig floor frame 108 via a rigid link and pins. However, the horizontal floor 140 can be directly and/or indirectly mechanically coupled to the first rig floor frame 108 via other mechanisms. During deployment, by mechanically coupling the horizontal floor 140 to the first rig floor frame 108, the first rig floor frame 108 and perhaps with the boom 142, can support the horizontal floor 140 and the raisable apparatus 138.

As in the illustrated example, a power cable spool 144 may be mounted on the skid 134. The power cable spool 144 can reel in and out a high-voltage power cable, which may extend to a stationary location at the wellsite that may include a generator (or set of generators) and/or a power control room. The high-voltage power cable may be a thick gauge cable with one or more conductors.

A communication cable spool 146 may also be mounted on the skid 134. The communication cable spool 146 can wind and unwind communication cable. The communication cable may include and/or be a fiber optic cable, a thin gauge cable, and/or other example cables.

One or more transformers 148 and one or more brake resistors 150 (e.g., two brake resistors 150) may be mounted on the skid 134. Multiple physical resistors may be electrically coupled in parallel and/or serially to form a brake resistor. One or more radiators 152 may also be mounted on the skid 134. The radiators 152 can be used to cool various components of the local electrical room module, such as by pumping cooling fluid through conduit to the lower electrical room 136 and/or the raisable apparatus 138. However, air-cooling may also or instead be used to remove heat from the various components, such as by using heat spreaders (e.g., with a heat sink that may include high heat conductance fins), and radiators may be omitted or used in addition to the air-cooling.

The driller control room module is deployed adjacent the first side box module. The first rig floor frame 108 of the first side box module includes support beams 162 that support the driller control room module, e.g., a driller control room 160, during deployment of the driller control room module. The support beams 162 may be hinged at the first rig floor frame 108. During transport of the first side box module, the support beams 162 may be folded, by operation of the hinge, to the first rig floor frame 108. In preparation of deployment and during deployment of the driller control room module, the support beams 162 may be unfolded to extend (e.g., perpendicularly) from the first rig floor frame 108 to support the driller control room module. The driller control room 160 may be deployed by a forklift, crane, and/or other example equipment capable of lifting and placing the driller control room 160 on the support beams 162. The driller control room module may be deployed before or after deployment of the local electrical room module. The raisable apparatus 138 of the local electrical room module may be proximate the driller control room 160 when the local electrical room module and the driller control room module are deployed. Additionally, the driller control room 160 may have one or more plug panels on one or more exteriorly facing walls thereof. The plug panel(s) of the driller control room 160 may be connected to one or more of the plug panel(s) of the raisable apparatus 138 via one or more cables. Hence, components in the driller control room 160 may be electrically coupled to the local electrical room module.

After deploying the above-described modules, the rig floor 116, the first rig floor frame 108, and the second rig floor frame 114 (e.g., the rig floor structure) of the well construction apparatus 100 are raised to an operational (e.g., drilling) level. The rig floor 116, the first rig floor frame 108, and the second rig floor frame 114, in the illustrated example, are raised via operation of the hydraulics system, including the hydraulic lift formed with the hydraulic cylinder 106 of the first side box module and the hydraulic lift of the second side box module. The hydraulic lifts can be extended, which cause the first moveable support structures 104 and the second moveable support structures to rotate to an upright, vertical position that, in turn, raises the rig floor 116, the first rig floor frame 108, and the second rig floor frame 114.

With the raising of the first rig floor frame 108, the horizontal floor 140 with the raisable apparatus 138 are also lifted. Since the horizontal floor 140 is mechanically coupled to the first rig floor frame 108, the raising of the first rig floor frame 108 also causes the horizontal floor 140 and raisable apparatus 138 to be raised.

With the rig floor 116, the first rig floor frame 108, the second rig floor frame 114, and the mast 124 raised, a drill line can be extend from the drawworks 122 to a deadline anchor on the rig floor 116, including through sheaves of the crown block and a traveling block (not shown) mechanically coupled to the top drive. By releasing out and reeling in the drill line at the drawworks 122, the top drive can be lowered and raised, respectively, along the mast 124 during drilling operations. The top drive can be operated using a power system.

Additional modules and components may be incorporated into the well construction apparatus 100. For example, a catwalk module, including a powered catwalk and tubular racks, and a pipe handling manipulator module can be included in the well construction apparatus 100. Further, a drilling fluid circulation system module including, for example, a shale shaker, a desander, a desilter, a degasser, a hopper, and/or one or more drilling fluid tanks, may be included in the well construction apparatus 100 and/or separate from the well construction apparatus 100 at the wellsite.

Some components may be implemented at the wellsite separate from the well construction apparatus 100. For example, power generation and control components at the wellsite may be separate from (e.g., some distance away from) the well construction apparatus 100, as described below. The power generation may include one or more generators operable to provide electrical power. A power control room (PCR) may control the operation of the power generation and, e.g., provide a protective apparatus in the case of a fault.

Figure 3:
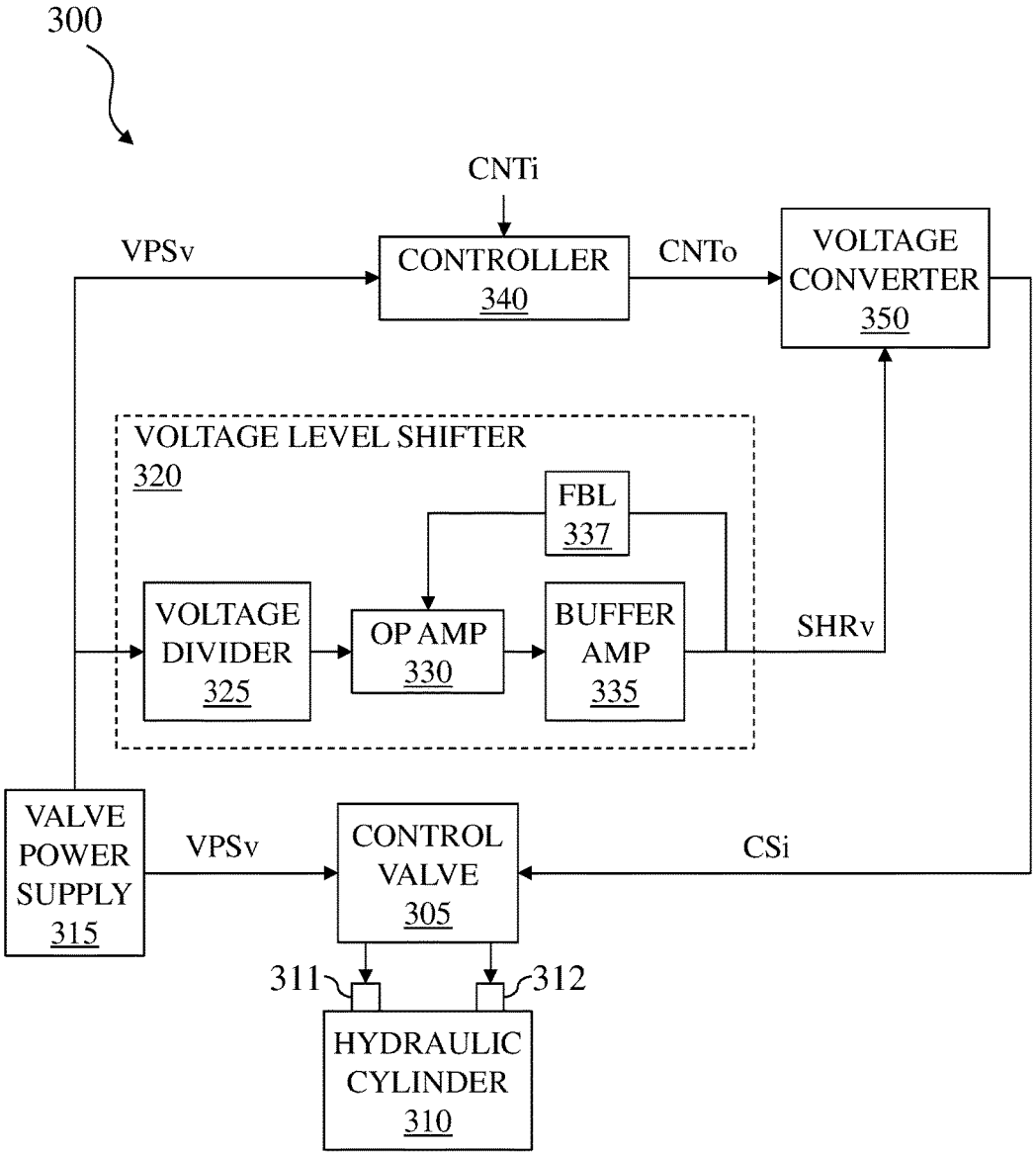
FIG. 3 is a schematic view of at least a portion of a simplified, example implementation of a control system for use with an electrically operated hydraulic control valve according to one or more aspects of the present disclosure.

FIG. 3 is a schematic view of at least a portion of a simplified, example implementation of a control system 300 for use with an electrically operated hydraulic control valve 305 according to one or more aspects of the present disclosure. The valve 305 may be operable in conjunction with the hydraulic cylinder 106 and/or other hydraulic apparatus described above.

FIG. 3 illustrates at least a portion of a one-line schematic of the apparatus for use with an implementation of the well construction apparatus 100 described above. The control system 300 can include other control components that are not illustrated, such as circuit breakers, switches, and others. A person having ordinary skill in the art will readily understand the applicability of such components, which are also within the scope of the present disclosure.

As introduced herein, the control system 300 provides a direct current (DC) voltage shift to a control signal input voltage (CSi) to control the electrically operated control valve 305. A valve power supply 315 provides a valve power supply voltage (VPSv), such as a DC supply voltage. When the CSi to the control valve 305 is equal (or substantially equal) to a fraction value (such as one half) of the VPSv, the control valve 305 applies zero hydraulic pressure to a first port 311 and a second port 312 of a hydraulic cylinder 310. The hydraulic cylinder 310 may be the hydraulic cylinder 106 and/or other hydraulic apparatus described above. The control valve 305 applies hydraulic pressure to the first port 311 when the CSi is greater than a fraction value of the VPSv. The control valve 305 applies hydraulic pressure to the second port 312 when the CSi is less than a fraction value of the VPSv. In this manner, the CSi can be employed to extend, retract, or maintain a position of an extendable element of the hydraulic cylinder 310.

In operation, the VPSv is applied to a resistor network such as a voltage divider 325 in a voltage level shifter 320 as illustrated in FIG. 3. The values of the resistors in the voltage divider 325 are chosen to provide the intended fraction of the VPSv. That fractional value of the VPSv is passed to an amplifier circuit (operational amplifier 330) to isolate its output voltage from its input. A feedback process formed with a buffer amplifier 335 and a feedback loop (FBL) 337 corrects for amplifier offsets so that the output voltage of the voltage level shifter 320 substantially matches the fraction value created by the resistor network in the voltage divider 325. A shift reference voltage (SHRv) produced by the voltage level shifter 320 is used as a reference voltage for a voltage converter 350. The voltage converter 350 can operate as a galvanically isolated digital-to-analog converter (DAC) for the control system 300. Thus, the voltage level shifter 320 is configured to produce the SHRv substantially equal to a fraction value of the VPSv.

A controller 340 is configured to produce a control system output voltage (CNTo) with a positive value, a negative value, or a zero value in response to a control input voltage (CNTi) and the VPSv. The voltage converter 350 is configured to receive the SHRv and the CNTo, and provide the CSi to the control valve 305. The CSi is controlled by the voltage converter 350 to be greater than the fraction value of the VPSv when the CNTo is the positive value, and less than the fraction value of the VPSv when the CNTo is the negative value. The CSi is controlled by the voltage converter 350 to be substantially equal to the fraction value of the VPSv when the CNTo is the zero value. Thus, the extendable element of the hydraulic cylinder 310 can be extended, retracted, or maintained stationary in response to the CNTi.

Figure 4:
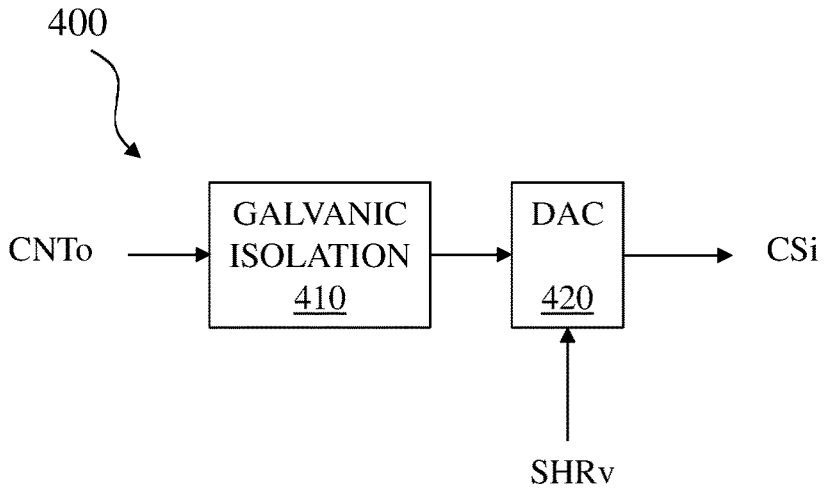
FIGS. 4 and 5 are each a schematic view of at least a portion of a simplified, example implementation of voltage converter according to one or more aspects of the present disclosure.

FIG. 4 is a schematic view of at least a portion of a simplified, example implementation of the voltage converter 350 according to one or more aspects of the present disclosure, designated in FIG. 4 by reference number 400. The voltage converter 400 is constructed with a galvanic isolation block 410 that can be employed to provide galvanic isolation between the CNTo and the CSi. The galvanic isolation of an input signal can be provided employing an opto-isolator or a magnetic circuit element, such as a transformer employing techniques well known in the art, and in the interest of brevity will not be described further herein. The input of a DAC 420 is coupled to the output of the galvanic isolation block 410 and to SHRv, and the DAC 420 produces the CSi. Thus, the CSi can be galvanically isolated from the CNTo, which may be employed to accommodate differences in local circuit ground voltages in a particular application.

Figure 5:
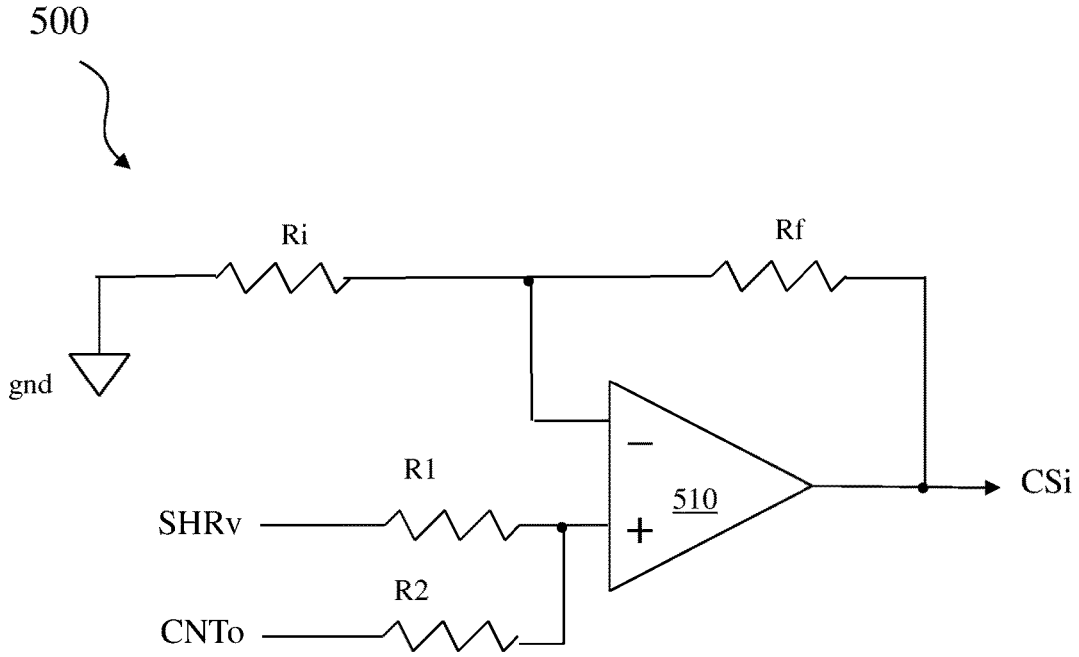

FIG. 5 is a schematic view of at least a portion of another simplified, example implementation of the voltage converter 350 according to one or more aspects of the present disclosure, in which the voltage converter 350 is formed as a summer 500. The voltage converter 500 is formed with an operational amplifier 510 that produces the CSi in response to the SHRv and the CNTo, each coupled respectively through resistors R1, R2 to a non-inverting input of the operational amplifier 510. An output of the operational amplifier 510 is coupled to its inverting input by a resistor divider formed with an input resistor Ri and a feedback resistor Rf.

If the resistance values of the resistors R1, R2 are equal, then the voltage applied to the non-inverting input of the operational amplifier 510 will be half the value of the SHRv when the CNTo is equal to zero, e.g., the voltage of local circuit ground. If the resistance values of the input resistor Ri and the feedback resistor Rf are equal, then the CSi will be twice the voltage level of the non-inverting input of the operational amplifier 510. The result is the CSi will be equal to the voltage level of the SHRv when the CNTo is zero. The CSi will be greater than the voltage level of the SHRv when the CNTo is positive. The CSi will be less than the voltage level of the SHRv when the CNTo is negative. Unlike the example voltage converter 400 illustrated in FIG. 4, the voltage converter 500 illustrated in FIG. 5 does not provide galvanic isolation between its inputs and output.

Figure 6:
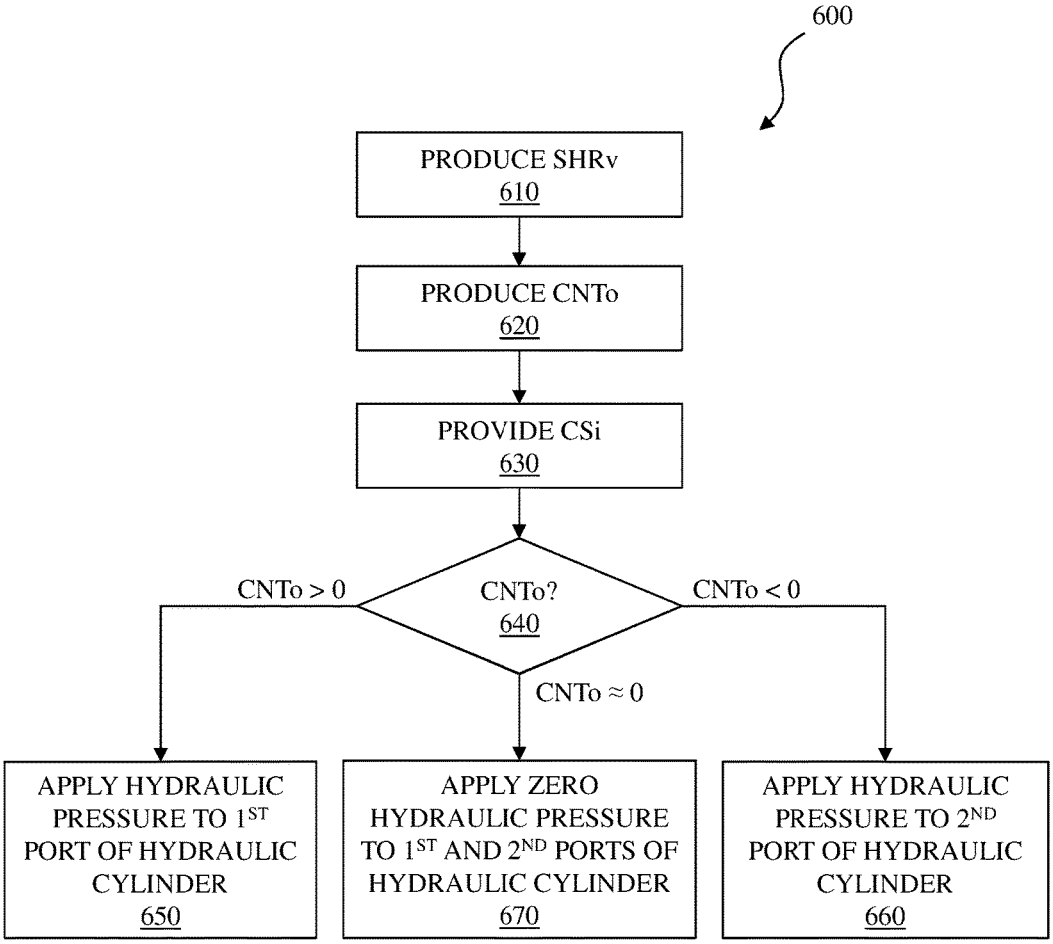
FIG. 6 is a flow-chart diagram of at least a portion of an example implementation of a method according to one or more aspects of the present disclosure.

FIG. 6 is a flow-chart diagram of at least a portion of an example implementation of a method (600) according to one or more aspects of the present disclosure. The method (600) may be performed utilizing at least a portion of one or more implementations of the apparatus shown in FIGS. 1-5 and/or otherwise within the scope of the present disclosure, including operating a control valve coupled to a hydraulic cylinder at the wellsite. As examples, reference numbers described above are included with respect to components described below for the method (600).

The method (600) is operable to control (e.g., in real time) a control valve such as the control valve 305. The control valve 305 is configured to apply non-zero hydraulic pressure to a first port 311 of a hydraulic cylinder 310 when a control signal input voltage (CSi) is greater than a fraction value (e.g., one half) of a valve power supply voltage (VPSv), apply non-zero hydraulic pressure to a second port 312 of the hydraulic cylinder 310 when the CSi is less than the fraction value of the VPSv, and apply zero hydraulic pressure to the first and second ports 311, 312 when the CSi is substantially equal to the fraction value of the VPSv. The hydraulic cylinder 310 may be configured to position a component of a well construction apparatus 100, such as the rig floor frame 108.

The method (600) comprises producing (610) the SHRv as substantially equal to the fraction value of the VPSv, such as via the voltage level shifter 320. The method (600) also comprises producing (620) the CNTo, with a positive value, a negative value, or a zero value in response to the CNTi and the VPSv, such as via the controller 340. The method (600) also comprises providing (630) the CSi as a function of the SHRv and the CNTo to the control valve 305, such as via the voltage converter 350.

The CNTo is then examined (640). If the CNTo is determined (640) to be a positive value, then hydraulic pressure is applied (650) to the first port 311 of the hydraulic cylinder 310, because the CSi is greater than the fraction value of the VPSv. If the CNTo is determined (640) to be a negative value, hydraulic pressure is applied (660) to the second port 312 of the hydraulic cylinder 310, because the CSi is less than the fraction value of the VPSv. If the CNTo is determined (640) to be substantially zero, zero hydraulic pressure is applied (670) to the first and second ports 311, 312, because the CSi is substantially equal to the fraction value of the VPSv.

Figure 7:
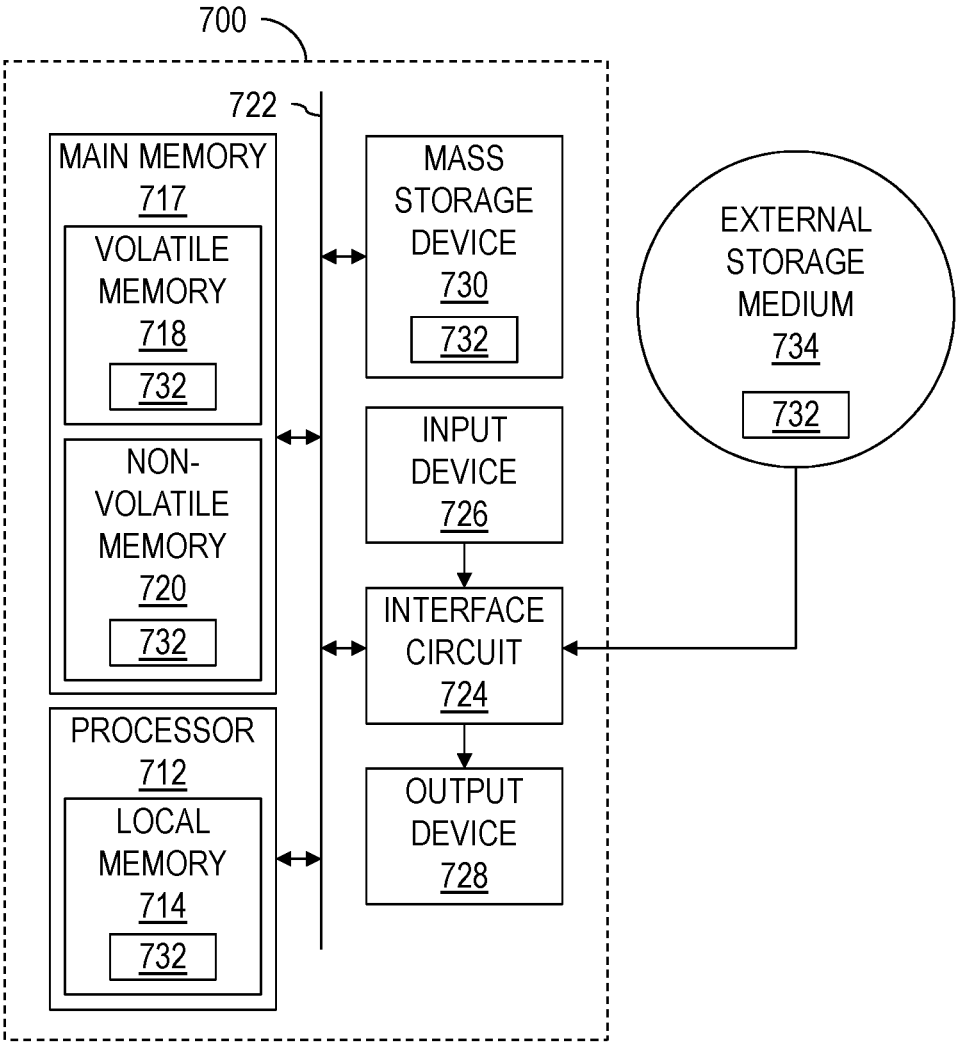
FIG. 7 is a schematic view of at least a portion of an example implementation of a processing system according to one or more aspects of the present disclosure.

FIG. 7 is a schematic view of at least a portion of an example implementation of a processing system 700 according to one or more aspects of the present disclosure. One or more instances of the processing system 700 may form at least a portion of processing/control apparatus described above, such as an implementation of the control system 300 of FIG. 3, and may execute example machine-readable instructions to implement at least a portion of one or more of the methods and/or processes described herein.

The processing system 700 may be or comprise, for example, one or more processors, controllers, special-purpose computing devices, server devices, personal computers, network appliances, programmable logic controller (PLC), industrial computer, and/or other types of computing devices. Various functionalities and components of a processing system can be in a single device or distributed across multiple devices.

The processing system 700 comprises a processor 712 such as, for example, a general-purpose programmable processor. The processor 712 may comprise a local memory 714, and may execute program code instructions 732 present in the local memory 714 and/or in another memory device. The processor 712 may execute, among other things, machine-readable instructions or programs to implement the methods and/or processes described herein. The programs stored in the local memory 714 may include program instructions or computer program code that, when executed by an associated processor, enable functionality as described herein. The processor 712 may be, comprise, or be implemented by one or more processors of various types operable in the local application environment, and may include one or more general purpose processors, special-purpose processors, microprocessors, digital signal processors (DSPs), field-programmable gate arrays (FPGAs), application-specific integrated circuits (ASICs), processors based on a multi-core processor architecture, and/or other processors. More particularly, examples of a processor 712 include one or more INTEL microprocessors, microcontrollers from the ARM and/or PICO families of microcontrollers, embedded soft/hard processors in one or more FPGAs, etc.

The processor 712 may be in communication with a main memory 717, such as via a bus 722 and/or other communication means. The main memory 717 may comprise a volatile memory 718 and a non-volatile memory 720. The volatile memory 718 may be, comprise, or be implemented by a tangible, non-transitory storage medium, such as random access memory (RAM), static random access memory (SRAM), synchronous dynamic random access memory (SDRAM), dynamic random access memory (DRAM), RAMBUS dynamic random access memory (RDRAM), and/or other types of random access memory devices. The non-volatile memory 720 may be, comprise, or be implemented by a tangible, non-transitory storage medium, such as read-only memory, flash memory and/or other types of memory devices. One or more memory controllers (not shown) may control access to the volatile memory 718 and/or the non-volatile memory 720.

The processing system 700 may also comprise an interface circuit 724 connected and communicatively coupled to the bus 722. The interface circuit 724 may be, comprise, or be implemented by various types of standard interfaces, such as an Ethernet interface, a universal serial bus (USB), a third generation input/output (3GIO) interface, a wireless interface, and/or a cellular interface, among other examples. The interface circuit 724 may also comprise a graphics driver card. The interface circuit 724 may also comprise a communication device such as a modem or network interface card to facilitate exchange of data with external computing devices via a network, such as via Ethernet connection, digital subscriber line (DSL), telephone line, coaxial cable, cellular telephone system, and/or satellite, among other examples.

One or more input devices 726 may be connected to the interface circuit 724. One or more of the input devices 726 may permit a user to enter data and/or commands for utilization by the processor 712. Each input device 726 may be, comprise, or be implemented by a keyboard, a mouse, a touchscreen, a track-pad, a trackball, an image/code scanner, and/or a voice recognition system, among other examples.

One or more output devices 728 may also be connected to the interface circuit 724. One or more of the output device 728 may be, comprise, or be implemented by a display device, such as a liquid crystal display (LCD), a light-emitting diode (LED) display, and/or a cathode ray tube (CRT) display, among other examples, which may further enable the GUIs 920 and 940 described above. One or more of the output devices 728 may also or instead be, comprise, or be implemented by a printer, speaker, and/or other examples.

The processing system 700 may also comprise a mass storage device 730 for storing machine-readable instructions and data. The mass storage device 730 may be connected to the interface circuit 724, such as via the bus 722. The mass storage device 730 may be or comprise a tangible, non-transitory storage medium, such as a floppy disk drive, a hard disk drive, a compact disk (CD) drive, and/or digital versatile disk (DVD) drive, among other examples. The program code instructions 732 may be stored in the mass storage device 730, the volatile memory 718, the non-volatile memory 720, the local memory 714, and/or on a removable storage medium 734, such as a CD or DVD.

The modules and/or other components of the processing system 700 may be implemented in accordance with hardware (such as in one or more integrated circuit chips, such as an ASIC), or may be implemented as software or firmware for execution by a processor. In the case of firmware or software, the implementation can be provided as a computer program product including a computer readable medium or storage structure containing computer program code (i.e., software or firmware) for execution by the processor.

In view of the entirety of the present disclosure, including the figures and the claims, a person having ordinary skill in the are will readily recognize that the present disclosure introduces an apparatus comprising a control system for use with a control valve, wherein: (A) the control valve is operable to apply: (i) non-zero hydraulic pressure to a first port of a hydraulic cylinder when a control signal input voltage (CSi) is greater than a fraction value of a valve power supply voltage (VPSv); (ii) non-zero hydraulic pressure to a second port of the hydraulic cylinder when the CSi is less than the fraction value of the VPSv; and (iii) zero hydraulic pressure to the first and second ports when the CSi is substantially equal to the fraction value of the VPSv; (B) the control system comprises: (i) a voltage level shifter that produces a shift reference voltage (SHRv) substantially equal to the fraction value of the VPSv; (ii) a controller that produces a control system output voltage (CNTo) with a positive value, a negative value, or a substantially zero value in response to a control input voltage (CNTi) and the VPSv; and (iii) a voltage converter that receives the SHRv and CNTo and provides the CSi to the control valve; and (C) the CSi is: (i) greater than the fraction value of the VPSv when the CNTo is the positive value; (ii) less than the fraction value of the VPSv when the CNTo is the negative value; and (iii) substantially equal to the fraction value of the VPSv when the CNTo is the substantially zero value.

The fraction value may be one half of a value of the VPSv.

The voltage converter may comprise galvanic isolation. In such implementations, among others within the scope of the present disclosure, the voltage converter may comprise a digital to analog converter.

The voltage converter may comprise a summer.

The voltage level shifter may comprise a voltage divider that produces the SHRv being substantially equal to the fraction value. The voltage level shifter may further comprise an operational amplifier isolating the SHRv from the VPSv. The voltage level shifter may further comprise a buffer amplifier and a feedback loop each coupled to the operational amplifier and operable to compensate for offsets associated therewith.

The hydraulic cylinder may be operable to position a component of a well construction apparatus. The component may be a rig floor frame of the well construction apparatus.

The apparatus may further comprise the control valve.

The present disclosure also introduces a method for use with a control valve, wherein: (A) the control valve is configured to apply: (i) non-zero hydraulic pressure to a first port of a hydraulic cylinder when a control signal input voltage (CSi) is greater than a fraction value of a valve power supply voltage (VPSv); (ii) non-zero hydraulic pressure to a second port of the hydraulic cylinder when the CSi is less than the fraction value of the VPSv; and (iii) zero hydraulic pressure to the first and second ports when the CSi is substantially equal to the fraction value of the VPSv; (B) the method comprises: (i) producing a shift reference voltage (SHRv) substantially equal to the fraction value of the VPSv; (ii) producing a control system output voltage (CNTo) with a positive value, a negative value, or a substantially zero value in response to a control input voltage (CNTi) and the VPSv; and (iii) providing the CSi as a function of the SHRv and CNTo to the control valve; and (C) the CSi is: (i) greater than the fraction value of the VPSv when the CNTo is the positive value; (ii) less than the fraction value of the VPSv when the CNTo is the negative value; and (iii) substantially equal to the fraction value of the VPSv when the CNTo is the substantially zero value.

The fraction value may be one half of a value of the VPSv.

Receiving the SHRv and providing the CSi may be performed with a voltage converter. The voltage converter may comprise: galvanic isolation and a digital to analog converter; or a summer.

Producing the SHRv may be performed with a voltage level shifter comprising a voltage divider operable to produce the SHRv being substantially equal to the fraction value. The voltage level shifter may further comprise an operational amplifier isolating the SHRv from the VPSv. The voltage level shifter may further comprise a buffer amplifier and a feedback loop each coupled to the operational amplifier and operable to compensate for offsets associated therewith.

The hydraulic cylinder may be operable to position a component of a well construction apparatus. The component may be a rig floor frame of the well construction apparatus.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus comprising:

a control system for use with a control valve, wherein:

the control valve applies:

non-zero hydraulic pressure to a first port of a hydraulic cylinder when a control signal input voltage (CSi) is greater than a fraction value of a valve power supply voltage (VPSv);

non-zero hydraulic pressure to a second port of the hydraulic cylinder when the CSi is less than the fraction value of the VPSv; and zero hydraulic pressure to the first and second ports when the CSi is substantially equal to the fraction value of the VPSv;

the control system comprises:

a voltage level shifter that produces a shift reference voltage (SHRv) substantially equal to the fraction value of the VPSv;

a controller that produces a control system output voltage (CNTo) with a positive value, a negative value, or a substantially zero value in response to a control input voltage (CNTi) and the VPSv; and a voltage converter that receives the SHRv and CNTo and provides the CSi to the control valve; and the CSi is:

greater than the fraction value of the VPSv when the CNTo is the positive value;

less than the fraction value of the VPSv when the CNTo is the negative value; and substantially equal to the fraction value of the VPSv when the CNTo is the substantially zero value.

2. The apparatus of claim 1 wherein the fraction value is one half of a value of the VPSv.

3. The apparatus of claim 1 wherein the voltage converter comprises galvanic isolation.

4. The apparatus of claim 3 wherein the voltage converter comprises a digital to analog converter.

5. The apparatus of claim 1 wherein the voltage converter comprises a summer.

6. The apparatus of claim 1 wherein the voltage level shifter comprises a voltage divider that produces the SHRv being substantially equal to the fraction value.

7. The apparatus of claim 6 wherein the voltage level shifter further comprises an operational amplifier isolating the SHRv from the VPSv.

8. The apparatus of claim 7 wherein the voltage level shifter further comprises a buffer amplifier and a feedback loop each coupled to the operational amplifier and operable to compensate for offsets associated therewith.

9. The apparatus of claim 1 wherein the hydraulic cylinder is operable to position a component of a well construction apparatus.

10. The apparatus of claim 9 wherein the component is a rig floor frame of the well construction apparatus.

11. The apparatus of claim 1 further comprising the control valve.

12. A method for use with a control valve, wherein:

the control valve applies:

non-zero hydraulic pressure to a first port of a hydraulic cylinder when a control signal input voltage (CSi) is greater than a fraction value of a valve power supply voltage (VPSv);

non-zero hydraulic pressure to a second port of the hydraulic cylinder when the CSi is less than the fraction value of the VPSv; and zero hydraulic pressure to the first and second ports when the CSi is substantially equal to the fraction value of the VPSv;

the method comprises:

producing a shift reference voltage (SHRv) substantially equal to the fraction value of the VPSv;

producing a control system output voltage (CNTo) with a positive value, a negative value, or a substantially zero value in response to a control input voltage (CNTi) and the VPSv; and providing the CSi as a function of the SHRv and CNTo to the control valve; and the CSi is:

greater than the fraction value of the VPSv when the CNTo is the positive value;

less than the fraction value of the VPSv when the CNTo is the negative value; and substantially equal to the fraction value of the VPSv when the CNTo is the substantially zero value.

13. The method of claim 12 wherein the fraction value is one half of a value of the VPSv.

14. The method of claim 12 wherein receiving the SHRv and providing the CSi is performed with a voltage converter.

15. The method of claim 14 wherein the voltage converter comprises:

galvanic isolation and a digital to analog converter; or a summer.

16. The method of claim 12 wherein producing the SHRv is performed with a voltage level shifter comprising a voltage divider operable to produce the SHRv being substantially equal to the fraction value.

17. The method of claim 16 wherein the voltage level shifter further comprises an operational amplifier isolating the SHRv from the VPSv.

18. The method of claim 17 wherein the voltage level shifter further comprises a buffer amplifier and a feedback loop each coupled to the operational amplifier and operable to compensate for offsets associated therewith.

19. The method of claim 12 wherein the hydraulic cylinder is operable to position a component of a well construction apparatus.

20. The method of claim 19 wherein the component is a rig floor frame of the well construction apparatus.

* * * * *